US005755897A

United States Patent [19]

Brill

[11] Patent Number: 5,755,897

[45] Date of Patent: May 26, 1998

[54] FORGEABLE NICKEL ALLOY

[75] Inventor: Ulrich Brill, Schwerte, Germany

[73] Assignee: Krupp VDM GmbH, Werdohl, Germany

[21] Appl. No.: 656,894

[22] Filed: Jun. 3, 1996

[30] Foreign Application Priority Data

Jul. 4, 1995 [DE] Germany ..... 195 24 234.3

[51] Int. Cl.[6] ..... C22C 19/05

[52] U.S. Cl. ..... 148/410; 148/428; 148/419; 20/443; 20/581.1

[58] Field of Search ..... 420/443, 446, 420/447, 448, 449, 450, 584.1; 148/428, 410, 419, 442

[56] References Cited

U.S. PATENT DOCUMENTS

| | | | |
|---|---|---|---|
| 3,607,243 | 9/1971 | Eiselstein et al. . | |
| 4,784,830 | 11/1988 | Ganesan et al. . | |
| 5,302,097 | 4/1994 | Brill | 420/584.1 |
| 5,330,591 | 7/1994 | Vasseur | 148/675 |
| 5,603,891 | 2/1997 | Brill | 420/443 |

FOREIGN PATENT DOCUMENTS

| | | |
|---|---|---|
| 0 338 574 A1 | 10/1989 | European Pat. Off. . |
| 0 508 058 A1 | 10/1992 | European Pat. Off. . |
| 0 549 286 A1 | 6/1993 | European Pat. Off. . |
| 0 611 938 A1 | 8/1994 | European Pat. Off. . |

*Primary Examiner*—David A. Simmons
*Assistant Examiner*—Margery S. Phipps
*Attorney, Agent, or Firm*—Meltzer, Lippe, Goldstein, Wolf & Schlissel, P.C.

[57] ABSTRACT

An austenitic carbide-strengthened nickel/chromium/iron foregeable alloy comprises (in % by weight) 0.2 to 0.4% carbon, 25 to 30% chromium, 8 to 11% iron, more than 2.4 to 3.0% aluminum, 0.01 to 0.15% yttrium, 0.01 to 0.20% titanium, 0.01 to 0.20% niobium, 0.01 to 0.10% zirconium, 0.001 to 0.015% magnesium, 0.001 to 0.010% calcium, max 0.030% nitrogen, max 0.50% silicon, max 0.25% manganese, max 0.020% phosphorus, max 0.010% sulfur, balance nickel and unavoidable melting conditioned impurities. The quantity of precipitable carbon C* is in the range 0.083% to 0.300%, where $C^*=C_{tot.}-(C_{diss.}+C_{fix.Ti}+C_{fix.Nb}+C_{fix.Zr})$.

1 Claim, 3 Drawing Sheets

FORGEABLE NICKEL ALLOY

The invention relates to a forgeable nickel alloy for articles having high resistivity to isothermal and cyclic high temperature oxidation, high strength at high temperatures and creep rupture strength at temperatures up to 1200° C.

Articles such as structural components of furnaces, firing frames, radiation tubes, furnace rollers, furnace muffles, supporting and attaching elements in kilns for ceramic products, catalyst foils and diesel glow plugs when in use are not only isothermally loaded at very high temperatures, for example, above 1000° C., but must also withstand the stress placed on them due to the cycling of temperatures during heating-up and cooling. They must therefore have good scaling resistance with both isothermal and cyclic oxidation, and possess adequate high-temperature strength and creep rupture strength. (All the following percentages are percentages by weight)

U.S. Pat. No. 3,607,243 disclosed for the first time an austenitic alloy having satisfactory resistance more particularly to cyclic oxidation at temperatures up to 1093° C. and having the following contents: up to 0.1% carbon, 58–63% nickel, 21–25% chromium, 1–1.7% aluminium, and optionally up to 0.5% silicon, up to 1.0% manganese, up to 0.6% titanium, up to 0.006% boron, up to 0.1% magnesium, up to 0.05% calcium, residue iron, the phosphorus content being below 0.030% and the sulphur content below 0.015%.

The high-temperature strength values are stated as follows: 80 MPa for 982° C., 45 MPa for 1093° C. and 23 MPa for 1149° C., the creep rupture strength after 1000 hours being 32 MPa for 871° C., 16 MPa for 982° C. and 7 MPa for 1093° C. A material designated NiCr23Fe, and also designated as Material No. 2.4851 and UNS N06601, which has contents within the ranges mentioned above, has been adopted for industrial use. This material can be satisfactorily used in the temperature range above 1000° C. This is due to the formation of a protective chromium oxide/aluminium oxide layer and more particularly to the low tendency of the oxide layer to peel off under alternating temperature stressing. The material has in this way developed into an important alloy in industrial furnace construction. Typical applications are radiation tubes for gas-heated and oil-heated furnaces and conveying rollers for continuous roller-hearth furnaces for the firing of ceramic products. The material is also suitable for parts of waste gas detoxification installations and petrochemical installations.

To further enhance the properties governing the use of the material (for utilization temperatures above 1100° C. to 1200° C.), according to U.S. Pat. No. 4,784,830 nitrogen in quantities of 0.04 to 0.1% are added to the material known from U.S. Pat. No. 3,607,243 a titanium content of 0.2 to 1.0% being at the same time required. Advantageously the silicon content should also be above 0.25% and so correlated with the titanium content as to produce a Si:Ti ratio of 0.85 to 3.0. The chromium contents are 19–28% and the aluminium contents 0.75–2.0% with nickel contents of 55–65%. As disclosed in U.S. Pat. No. 3,607,243, the carbon content should also not exceed 0.1%, to avoid any formation of carbides, more particularly of the $M_{23}C_6$ type, since these have an adverse effect on microstructure and on the properties of the alloy at very high temperatures.

These steps achieve an improvement in resistance to oxidation at utilization temperatures up to 1200° C. As a result it was possible to increase the service life of, for example, furnace rollers to 12 months and more, as against 2 months in the case of furnace rollers produced from the material disclosed in U.S. Pat. No. 3,607,243. This improvement in the service life of structural components of furnaces is mainly due to a stabilization of the microstructure by titanium nitrides at temperatures of 1200° C. However, the service life of high-temperature-resistance articles is determined not only by resistance to oxidation, expressed by the so-called specific change of mass in $g/m^2 \cdot h$ in air at high testing temperatures, for example, 1093° C., as described in U.S. Pat. No. 4,784,830, but also by high-temperature strength and creep rupture strength at the particular utilization temperatures.

To obtain improved high-temperature and creep rupture strengths, more particularly at temperatures up to 1200° C., EP 0 508 058 A1 discloses the addition of carbon contents of 0.12 to 0.30%, in conjunction with the stable carbide formers titanium (0.01 to 1.0%), niobium (0.01 to 1.0%) and zirconium (0.01 to 0.20%), to a nickel alloy containing 23–30% chromium, 8–11% iron, 1.8–2.4% aluminium, 0.01–0.15% yttrium, 0.001–0.015% magnesium, 0.001–0.010% calcium, with maximum contents of 0.030% nitrogen, 0.50% silicon, 0.25% manganese, 0.020% phosphorus and 0.010% sulphur. Minimum chromium contents of 23% are prescribed, to ensure adequate resistance to oxidation at temperatures above 1100° C.

The high-temperature and creep rupture strengths obtained with this material are an improvement on the hitherto obtained 1% creep limits ($R_{p1.0/10^4}$) and creep rupture strengths ($R_{m/10^4}$) and also high-temperature strength ($R_m$) and yield points ($R_{p1.0}$) in the temperature range of 850°–1200° C. However, applications exist in which these creep strengths are not yet adequate. This is more particularly the case with cassettes and firing frames, in which the cross-section of the material must be very thin for economic reasons, and also applies for the linings of the combustion chambers of gas turbines, in which any significant improvement in efficiency can be achieved only with appreciably higher wall and operating temperatures.

It is therefore an object of the invention to devise a forgeable nickel alloy such that it has adequate resistance to oxidation, while at the same time showing a durable improvement in creep rupture strength values, the result being that either the service life of articles made from such alloys is significantly extended, or else their economics are appreciably improved for the same service life due to higher temperature loadability.

This problem is solved by an austenitic carbide-strengthened nickel/chromium/iron forgeable alloy consisting of 0.20 to 0.40% carbon
25.0 to 30.0% chromium
8.0 to 11.0% iron
2.3 to 3.0%, such as more than 2.4 to 3.0%, aluminum to 3.0% aluminium
0.01 to 0.15% yttrium
0.01 to 0.20% titanium
0.01 to 0.20% niobium
0.01 to 0.10% zirconium
0.001 to 0.015% magnesium
0.001 to 0.010% calcium
max 0.030% nitrogen
max 0.50% silicon
max 0.25% manganese
max 0.020% phosphorus
max 0.010% sulphur
residue nickel
including unavoidable melting-conditioned impurities, the precipitatable carbon C*, $C=C_{tot.}-(C_{diss.}+C_{fix.Ti}+C_{fix.Nb}+C_{fix.Zr})$ amounting to at least 0.083% to 0.300%

In the Equation:

$C_{diss.}$=carbon content dissolved at 1000° C. (%)

$C_{fix.Ti}$=carbon content stoichiometrically fixed from titanium (%)

$C_{fix.Nb}$=carbon content stoichiometrically fixed from niobium (%)

$C_{fix.Zr}$=carbon content stoichiometrically fixed from zirconium (%)

In comparison with the prior art, the carbide-strengthened nickel/chromium/iron forgeable alloy according to the invention not only has carbon contents defined from 0.20 to 0.40%, but also with C*≧0.083% carbon gives a rate for the remaining, precipitatable carbon. Surprisingly, tests have shown that with precipitatable carbon contents greater than or equal to 0.083%, $Cr_{23}C_6$ carbides previously observed were not precipitated, but primarily precipitated $Cr_7C_3$ were to be observed. Their quantity increases with increasing C* content. The $Cr_7C_3$ carbides, precipitated between liquidus and solidus temperature have a comparable strength-enhancing effect to titanium carbide, niobium carbide and zirconium carbide.

Minimum chromium contents of 25.0% are required to ensure adequate resistance to oxidation, more particularly at temperatures above 1100° C. Moreover, the value should not fall below this limit, since with decreasing chromium content the quantity of dissolved and therefore unprecipitatable carbon increases. The upper limit should not exceed 30%, to avoid problems in the hot shaping of the alloy.

The addition of yttrium in the limits of 0.01 to 0.15% durably improves resistance to cyclic oxidation.

Contents lower than 0.01% exert no significant influence on the adhesive strength of the oxide layers. On the other hand, yttrium contents higher than 0.15% may lead to limited hot shaping, due to local fusings.

More particularly in the temperature range of 600° to 800° C., through which the material passes in use both during heating-up and also cooling, aluminium produces an increase in hot-temperature strength by the precipitation of the $Ni_3Al$ phase ($\tau'$ phase). Since the precipitation of this phase is at the same time connected with a decrease in toughness, the aluminium contents must be limited. Determination of elongation after rupture in the temperature range from room temperature to 1200° C. showed no significant reduction of elongation after fracture in the temperature range of 600° to 800° C., so that it was possible to determine the aluminium content as 2.3 to 3.0%.

The silicon content should be as low as possible, to avoid the formation of low-melting phases. Thus, the silicon content should be equal or lower than 0.50%; nowadays this can be technically controlled without problems.

The manganese content should not exceed 0.25%, to prevent negative effects on the resistance of the material to oxidation.

Additions of magnesium and calcium prove hot shapeability can also have an improving effect on resistance to oxidation. However, the upper limits of 0.015% for magnesium and 0.010% for calcium should not be exceeded, since magnesium and calcium contents higher than these limit values encourage the occurrence of low-melting phases and therefore again cause a deterioration in hot shapeability.

The iron content of the alloy according to the invention is in the range of 8 to 11%, to enable cheap ferrochromium and ferronickel to be used in the melting of the alloy, instead of more expensive pure nickel and chromium metal.

The advantages obtained by the alloy according to the invention will now be explained in greater detail.

Table 1 contains analyses of six prior art alloys A, B, C, D, G, H and five alloys according to the invention E, F, I, J, K.

Table 2 shows the contents of precipitated $Cr_{23}C_6$ and $Cr_7C_3$ carbide calculated for the alloys A–K.

BRIEF DESCRIPTION OF THE DRAWINGS

The material properties of these alloys can be gathered from FIGS. 1 to 3, wherein:

FIG. 1 shows the elongation after rupture of the alloys I and J according to the invention and also of the prior art alloys D, C and H over the temperature range from room temperature to 1200° C. The alloys according to the invention can be seen to have exceptionally good ductility over the entire temperature range.

Figure 1:
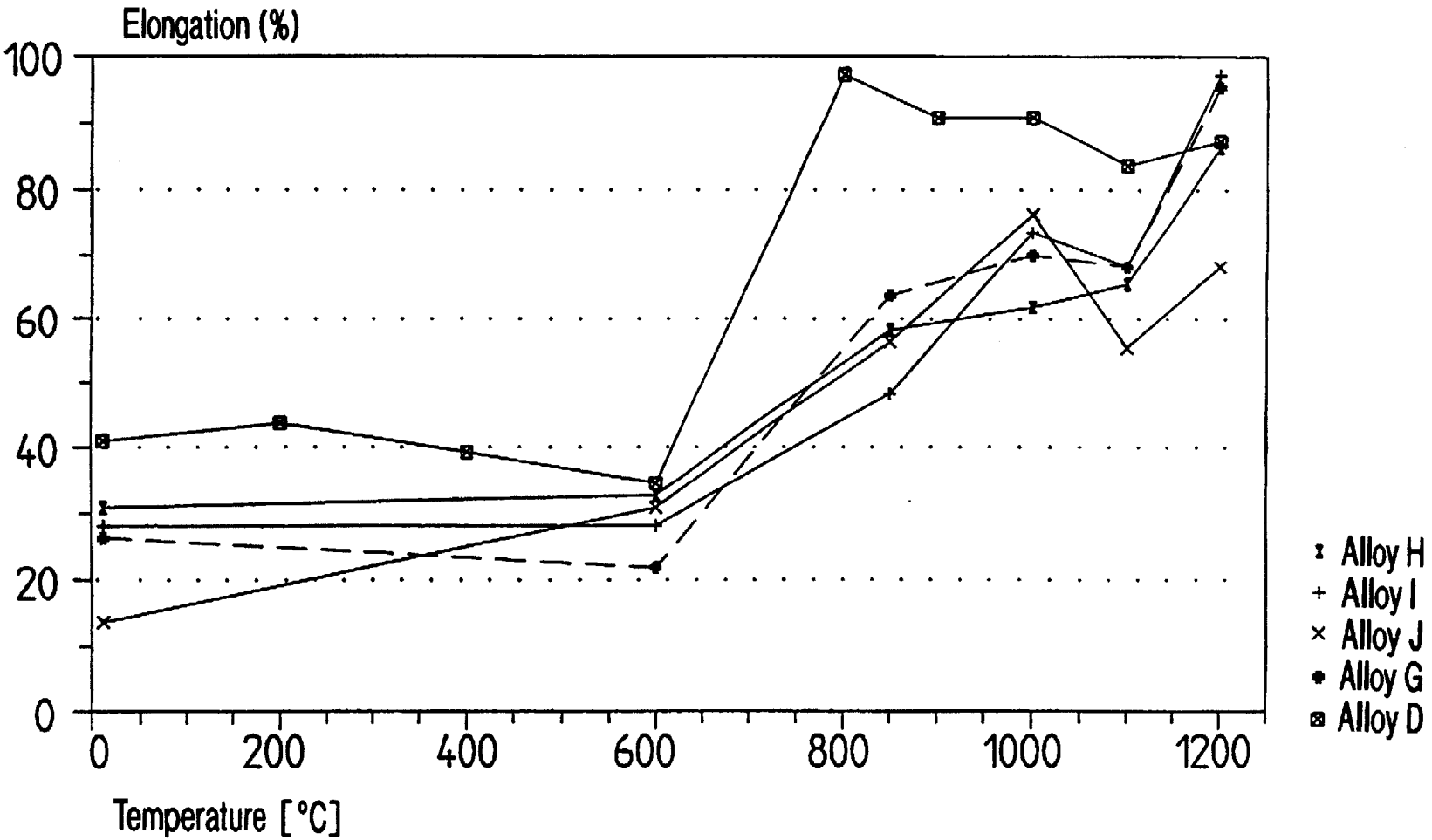
FIG. 1 elongation after rupture for the temperature range room temperature to 1200° C. for the alloys H, I, J, G and D, FIG. 2 the life in the creep stress rupture test for 850° C., 1000° C. and 1200° C., in dependence on C* for the alloys A–K, and FIG. 3 resistance to cyclic oxidation, determined in air, for the temperature range 850°–200° C. for the alloys A–K.
Figure 2:
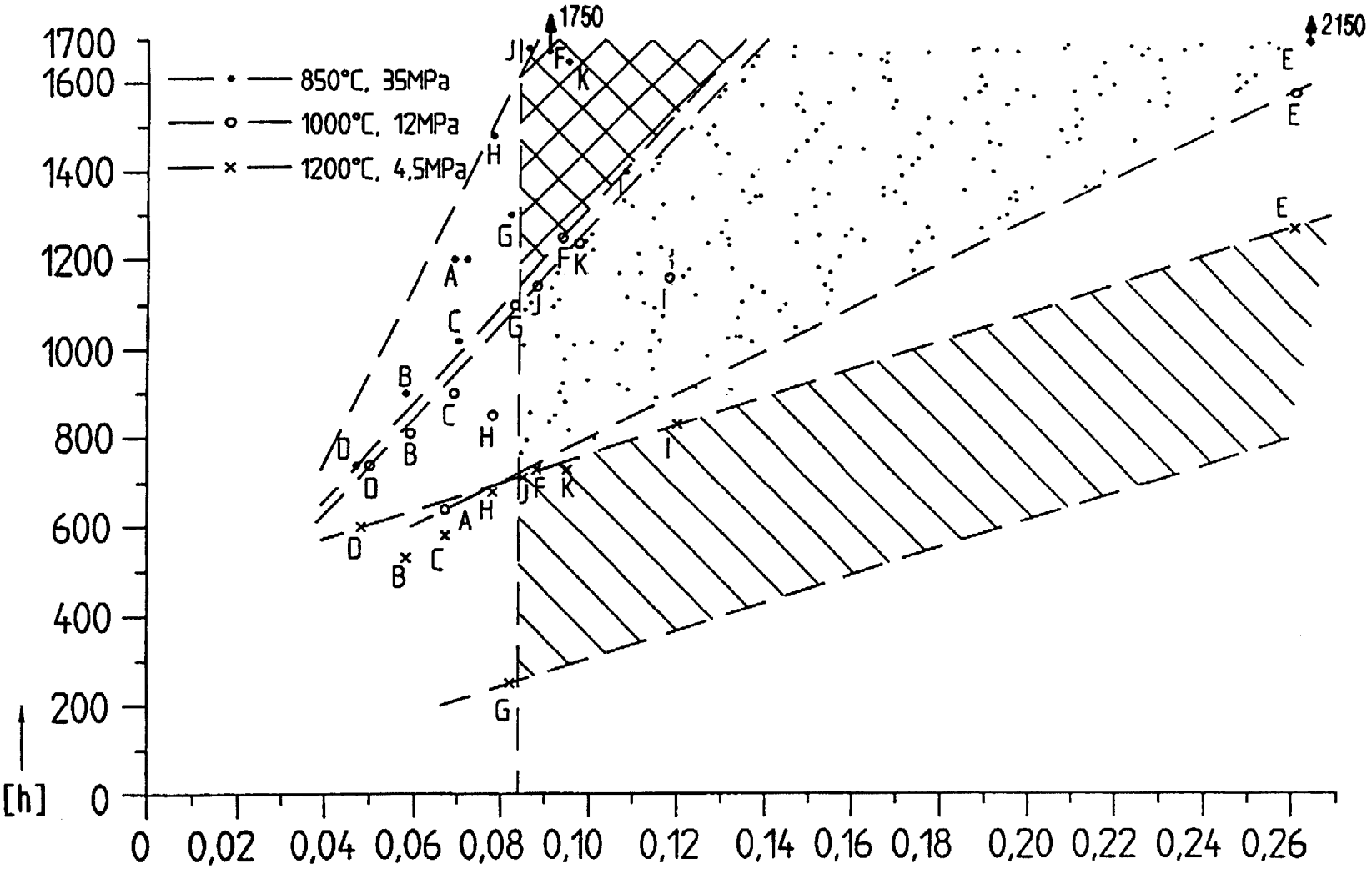
FIG. 2 shows clearly how at all the temperatures investigated the creep rupture strength of the alloys A–K, determined in the stress rupture test with 35 MPa for 850° C., 12 MPa for 1000° C. and 4.5 MPa for 1200° C., indicates that the alloys E, F and I–K according to the invention, with C*≧0.083% have appreciably longer lives than the prior art alloys A–D and G–H.
Figure 3:
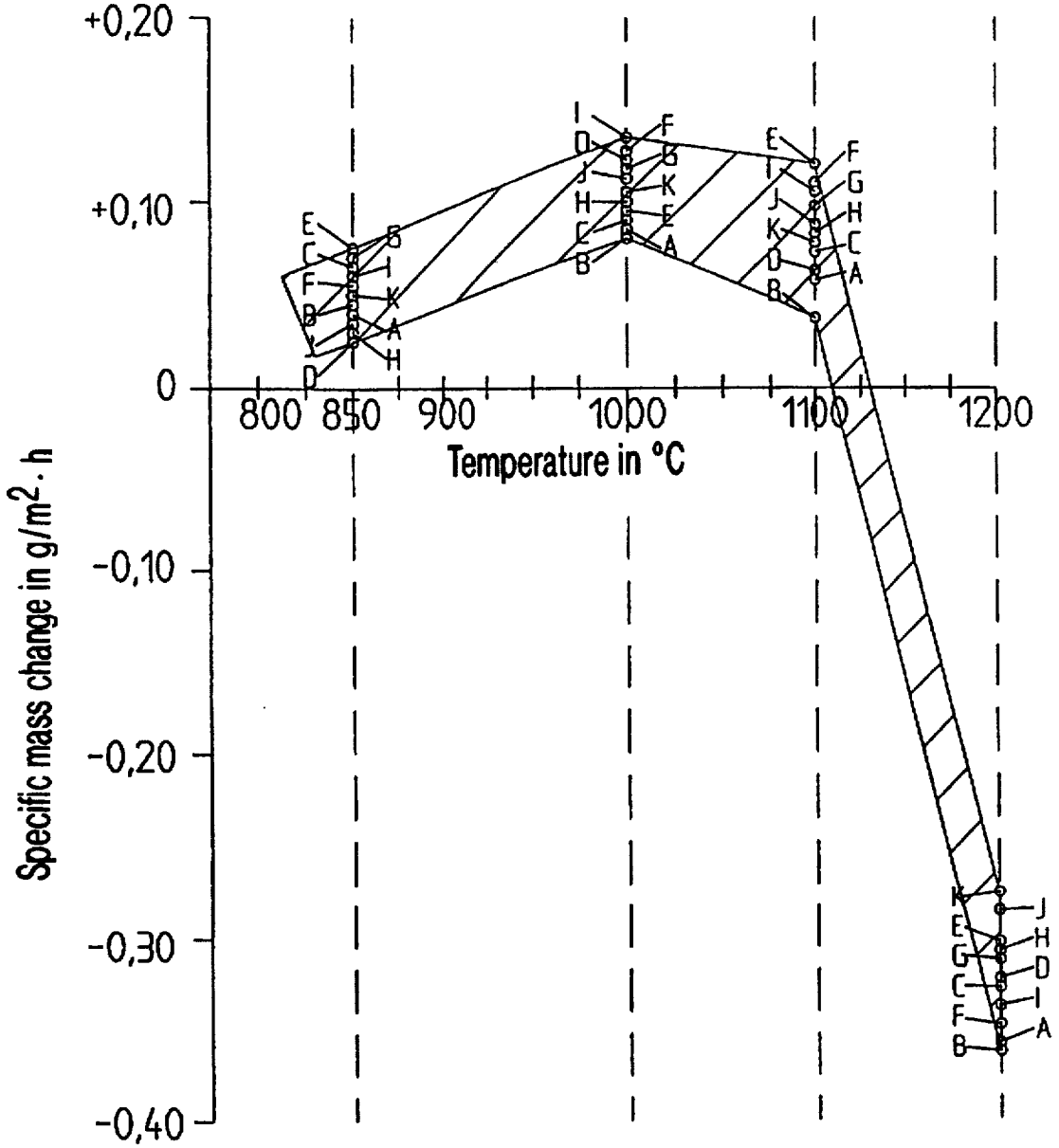
In FIG. 3 the resistance to cyclic oxidation, determined in air, of the alloys A–K is compared by plotting the specific change in mass over temperature. As a rule, an increase in mass (+) is desired. Decreases (−) in mass are an indication of heavily peeling scale.

All the alloys investigated lie in a very narrow scatter band of max ±0.040 $g/m^2h$ and therefore allow it to be stated that, in spite of their high content of precipitatable carbon, the alloys E, F and I–K according to the invention are not liable to any limited resistance to oxidation in comparison with the prior art.

Due to their good mechanical properties at temperatures up to 1200° C., accompanied by no less satisfactory resistance to cyclic oxidation, the austenitic carbide-strengthened nickel/chromium/iron forgeable alloy according to the invention is particularly suitable for the following:

radiation tubes for heating furnaces, furnace rollers for the annealing of ceramic or metal materials, conveyor belts in continuous annealing furnaces, e.g., for the annealing of stamped metal parts, muffles for the bright annealing, e.g., of high-grade steels, retorts for the annealing of magnet cores, tubes for oxygen heating in $TiO_2$ production, ethylene cracking tubes, furnace frames and furniture, thermocouple protective tubes, cassettes and supporting frames for steady state annealings, glow plugs and exhaust gas catalyst foils, supporting constructions for exhaust elbow insulations.

The above articles can readily be produced from the material according to the invention, since it is not only suitable for hot working but also for cold working processes, for example, the cold rolling of thin dimensions, folding, deep-drawing, edging.

Additionally, problems are not encountered in welding the material using the present-day techniques available.

TABLE 1

| Elements | Alloys | | | | | | | | | | |
|---|---|---|---|---|---|---|---|---|---|---|---|
| in % | A | B | C | D | E+ | F | G | H | I | J+ | K+ |
| C | 0.209 | 0.20 | 0.20 | 0.18 | 0.35 | 0.222 | 0.217 | 0.216 | 0.255 | 0.220 | 0.225 |
| Cr | 29.5 | 29.9 | 26.1 | 25.4 | 25.0 | 25.6 | 25.0 | 25.6 | 25.7 | 25.6 | 25.20 |
| Fe | 5.60 | 5.60 | 1.12 | 9.45 | 9.35 | 9.50 | 9.10 | 9.40 | 9.40 | 9.30 | 9.60 |
| Al | 2.20 | 1.72 | 2.18 | 2.09 | 2.80 | 2.32 | 2.37 | 2.36 | 2.34 | 2.85 | 2.78 |
| Y | 0.20 | 0.01 | 0.20 | 0.08 | 0.10 | 0.01 | 0.09 | 0.10 | 0.11 | 0.06 | 0.080 |
| Ti | 0.19 | 0.20 | 0.15 | 0.14 | 0.05 | 0.18 | 0.17 | 0.18 | 0.18 | 0.18 | 0.16 |
| Cb | 0.01 | 0.005 | 0.01 | 0.01 | 0.01 | 0.01 | 0.03 | 0.01 | 0.01 | 0.01 | 0.01 |
| Zr | 0.09 | 0.09 | 0.08 | 0.08 | 0.01 | 0.07 | 0.08 | 0.08 | 0.08 | 0.08 | 0.070 |
| Mg | 0.01 | 0.01 | 0.01 | 0.01 | 0.003 | 0.001 | 0.006 | 0.006 | 0.005 | 0.002 | 0.008 |
| Ca | 0.001 | 0.001 | 0.001 | 0.001 | 0.001 | 0.001 | 0.001 | 0.001 | 0.001 | 0.001 | 0.002 |
| N | 0.006 | 0.003 | 0.004 | 0.035 | 0.032 | 0.031 | 0.033 | 0.035 | 0.035 | 0.036 | 0.029 |
| Si | 0.05 | 0.05 | 0.06 | 0.06 | 0.05 | 0.03 | 0.03 | 0.03 | 0.03 | 0.03 | 0.03 |
| Mn | 0.03 | 0.03 | 0.02 | 0.12 | 0.13 | 0.14 | 0.14 | 0.14 | 0.14 | 0.13 | 0.09 |
| P | 0.005 | 0.005 | 0.009 | 0.009 | 0.008 | 0.007 | 0.008 | 0.008 | 0.008 | 0.007 | 0.007 |
| S | 0.002 | 0.002 | 0.003 | 0.003 | 0.003 | 0.002 | 0.002 | 0.002 | 0.002 | 0.002 | 0.002 |
| W | — | — | 5.20 | — | — | — | — | — | — | — | — |
| Ni | Rest | Rest | Rest | Rest | Rest | Rest | Rest | Rest | Rest | Rest | Rest |
| C* | 0.068 | 0.058 | 0.068 | 0.048 | 0.255 | 0.087 | 0.081 | 0.079 | 0.118 | 0.083 | 0.095 |

+according to the invention

TABLE 2

| Alloy | Amount of carbides calculated from the C*-values | | |
|---|---|---|---|
| | C* in % | $^{m}Cr_{23}C_6$ in % | $^{m}Cr_7C_3$ in % |
| A | 0.068 | 1.20 | – |
| B | 0.058 | 1.02 | – |
| C | 0.068 | 1.20 | – |
| D | 0.048 | 0.85 | – |
| E+ | 0.255 | – | 2.83 |
| F | 0.087 | – | 0.97 |
| G | 0.081 | 1.43 | – |
| H | 0.079 | 1.40 | – |
| I | 0.118 | – | 1.31 |
| J+ | 0.083 | – | 0.92 |
| K+ | 0.095 | – | 1.06 |

+according to the invention

I claim:

1. A forgeable carbide-strengthened austenitic nickel alloy with improved high temperature creep strength, consisting essentially of in % by weight 0.20 to 0.40% carbon, the quantity of precipitatable carbon C* given by the formula $$C^*=C_{tot.}-(C_{diss.}+C_{fix.Ti}+C_{fix.Nb}+C_{fix.Zr})$$

being at least 0.083% to 0.300%, 25 to 30.0% chromium, 8 to 11.0% iron, more than 2.4 to 3.0% aluminum, 0.01 to 0.15% yttrium, 0.01 to 0.20% titanium, 0.01 to 0.20% niobium, 0.01 to 0.10% zirconium, 0.001 to 0.015% magnesium, 0.001 to 0.010% calcium, max 0.030% nitrogen, max 0.50% silicon, max 0.25% manganese, max 0.020% phosphorus, max 0.010% sulphur, balance nickel, including unavoidable melting-conditioned impurities.

* * * * *